United States Patent [19]

Pickett

[11] 4,111,401

[45] Sep. 5, 1978

[54] CONSTRUCTION ASSEMBLIES

[76] Inventor: William Hayden Pickett, 44 Lake Rd., Framingham, Mass. 01701

[21] Appl. No.: 705,350

[22] Filed: Jul. 14, 1976

[51] Int. Cl.[2] ..... E04H 17/14

[52] U.S. Cl. ..... 256/13.1; 256/26; 52/71; 52/227; 52/285; 52/206

[58] Field of Search ..... 52/227, 585, 71, 583, 52/584, 245, 223, 225, 587, 206; 256/19, 13.1, 24, 25, 26, 29, 73; 61/4, 5, 33, 38; 404/6, 4, 37, 38; 16/150

[56] References Cited

U.S. PATENT DOCUMENTS

| | | | |
|---|---|---|---|
| 1,112,018 | 9/1914 | McGillivray | 61/38 |
| 1,144,144 | 6/1915 | McGillivray | 61/38 |
| 1,383,166 | 6/1921 | Steinkraus | 52/593 |
| 2,036,363 | 4/1936 | Schaefer | 52/245 |
| 3,732,653 | 5/1973 | Pickett | 256/19 |
| 3,783,968 | 1/1974 | Derry | 256/13.1 |

FOREIGN PATENT DOCUMENTS

| | | | |
|---|---|---|---|
| 1,300,536 | 6/1962 | France | 256/13.1 |
| 120,872 | 11/1918 | United Kingdom | 52/584 |
| 938,939 | 10/1963 | United Kingdom | 52/245 |

*Primary Examiner*—John E. Murtagh

[57] ABSTRACT

A series of preformed panels are joined together at mating elongated male and female joint portions. The joint portions are secured together by a series of discrete spaced apart flexible tension members looped about portions of each panel.

16 Claims, 29 Drawing Figures

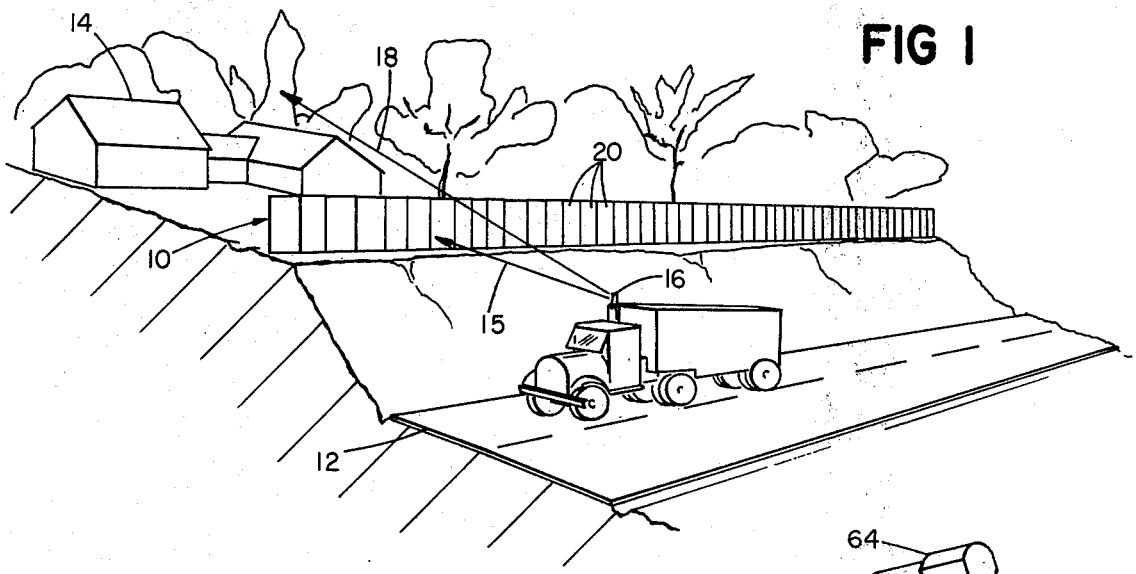
FIG 1
FIG 2
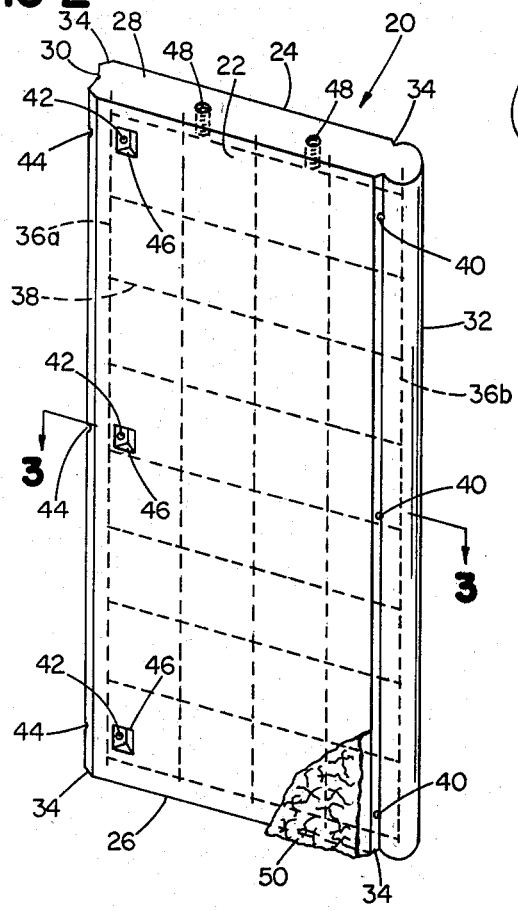
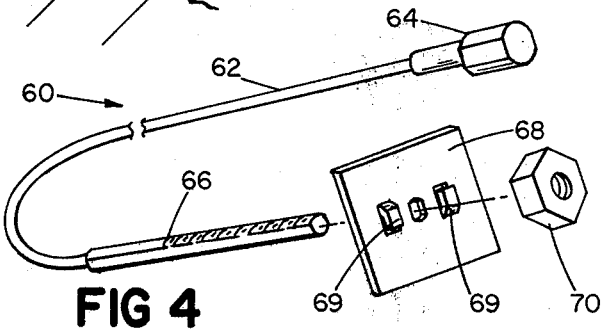
FIG 4
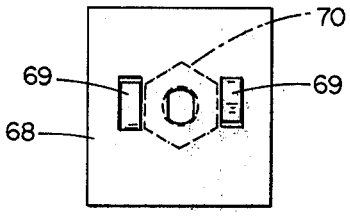
FIG 4a
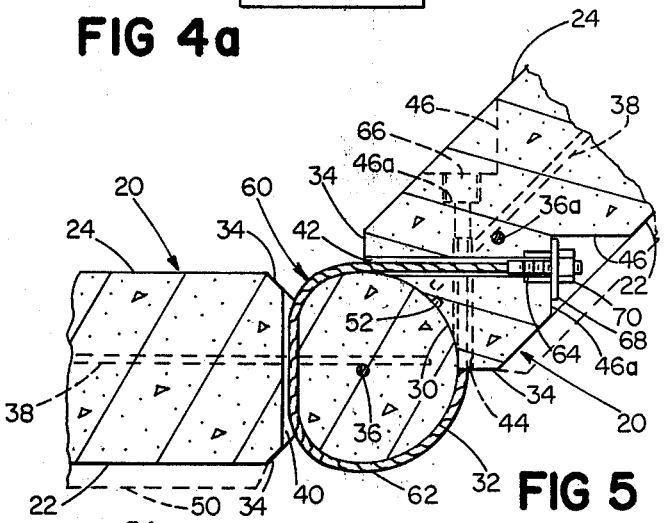
FIG 5
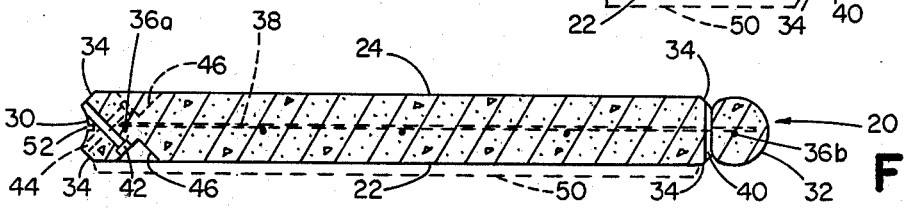
FIG 3

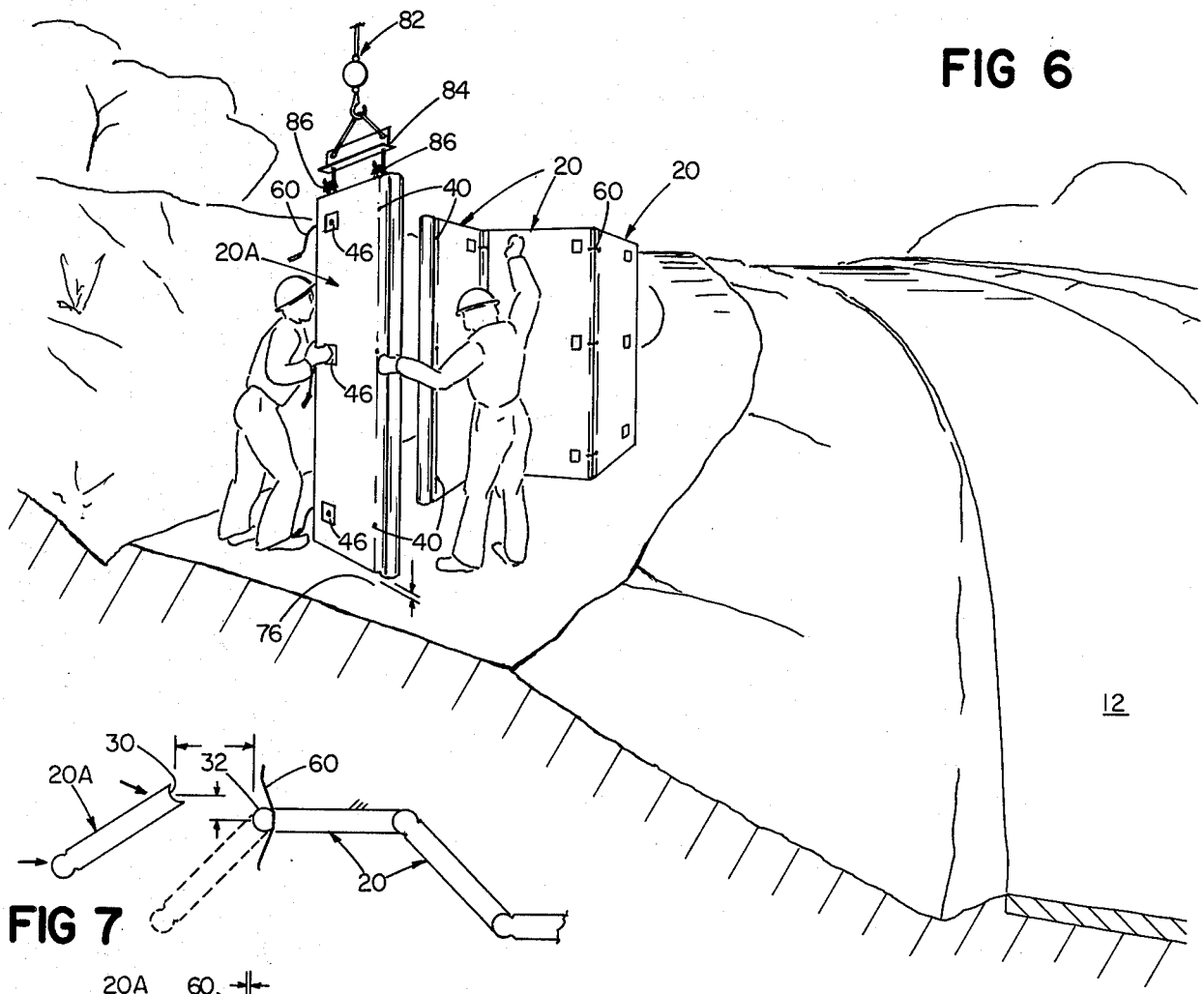
FIG 6
FIG 7
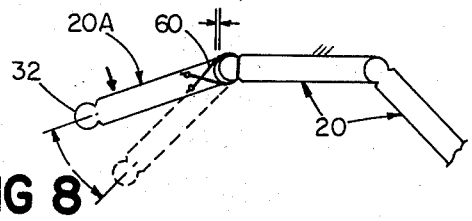
FIG 8
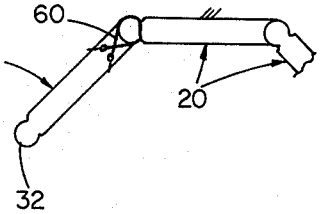
FIG 9
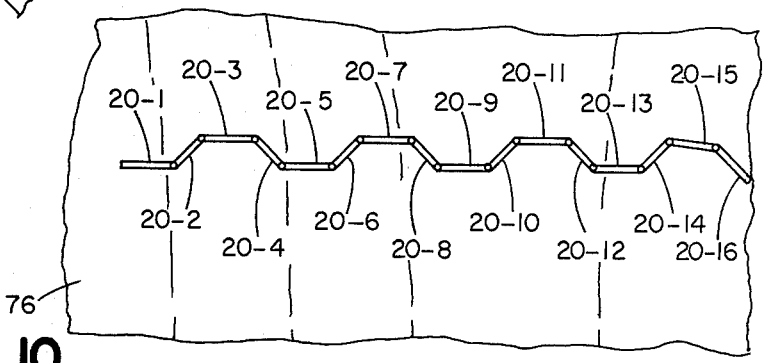
FIG 10
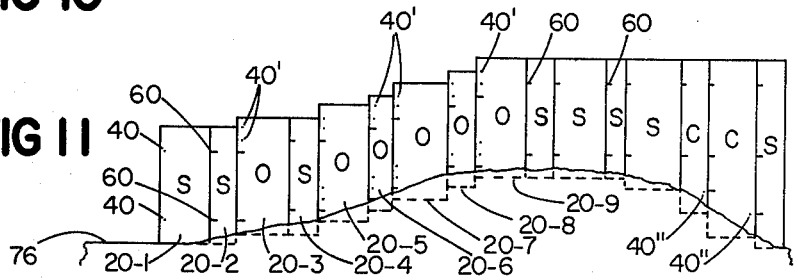
FIG 11

FIG 20
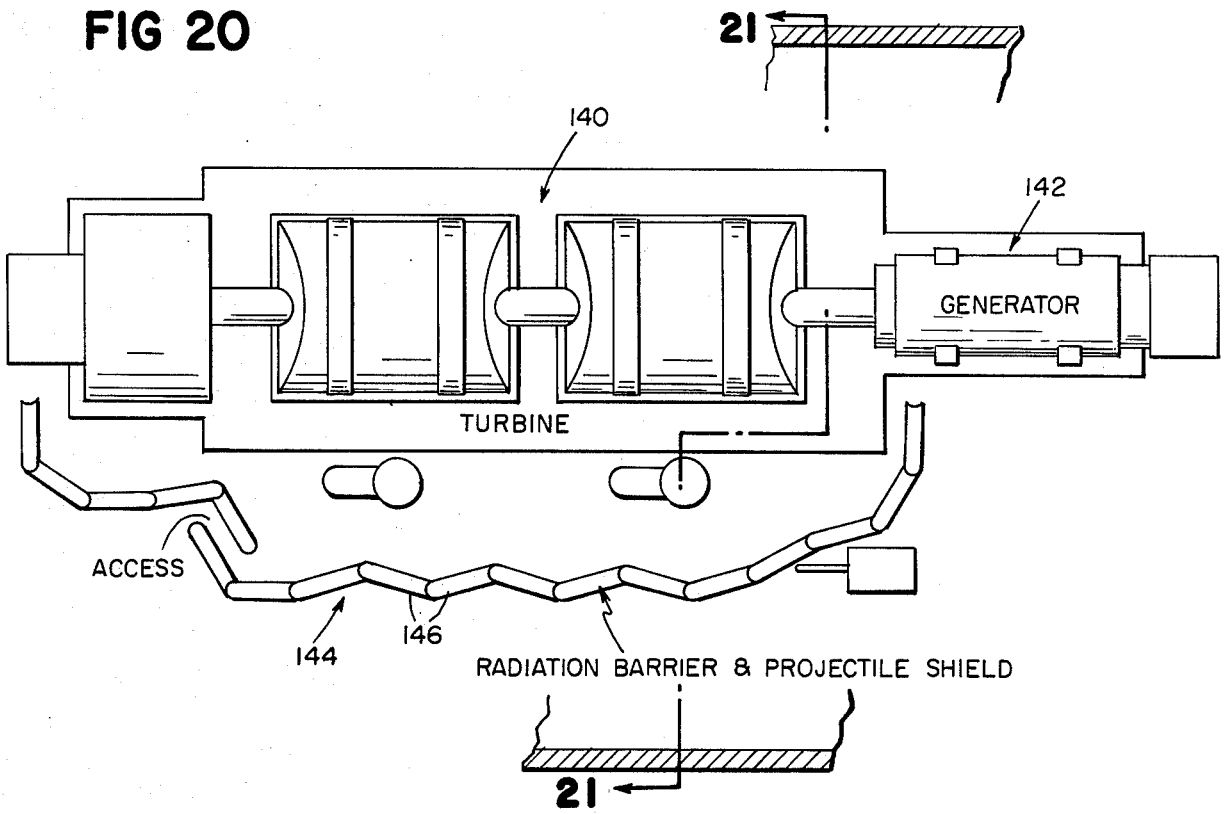
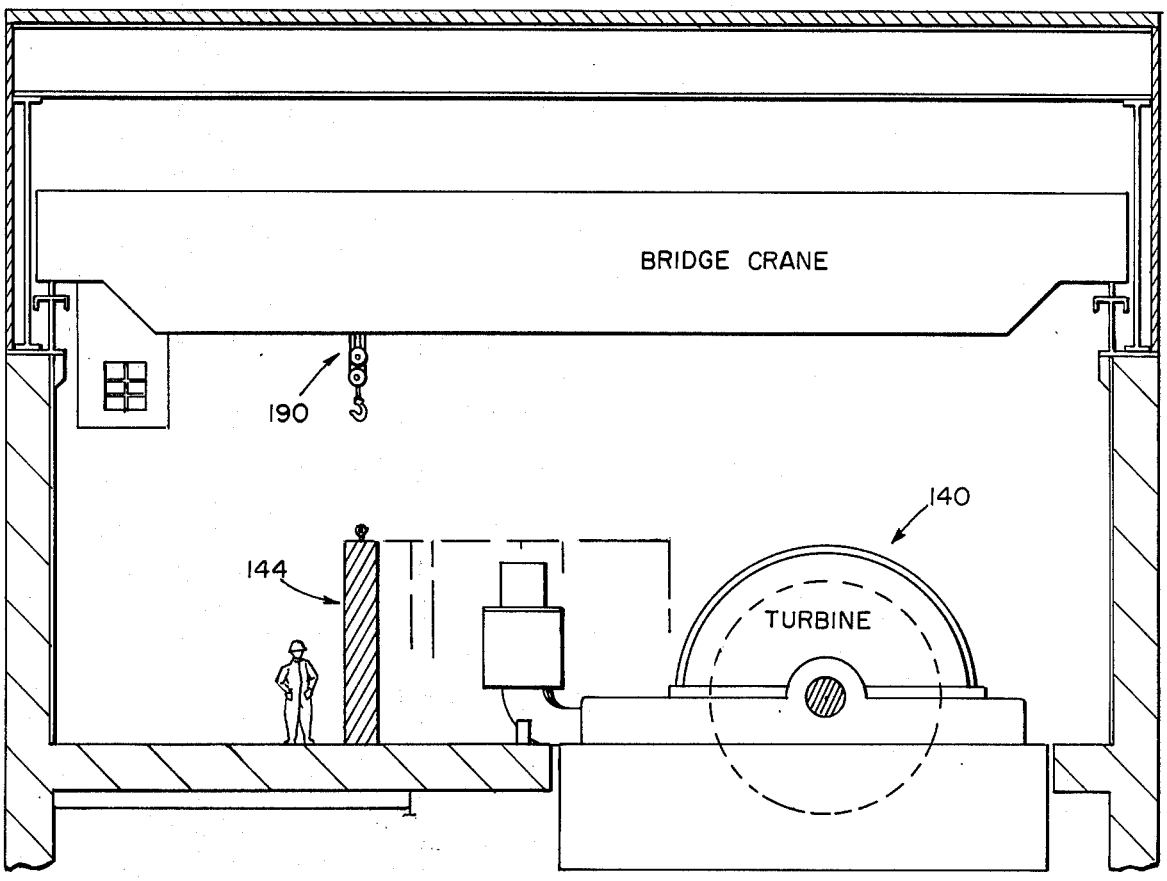
FIG 21

CONSTRUCTION ASSEMBLIES

This invention relates to construction assemblies and to modular components useful to form barrier walls and the like.

Extended construction assemblies in the nature of barriers are needed in many instances. An example is a noise control barrier along a vehicular right of way as where a highway passes through an established residential area. The structure should provide effective sound reduction at low cost of manufacture, installation and maintenance. It also should be sturdy, durable and safe. An object of the invention is to provide improved construction assemblies and modular components thereof suitable for use as sound barriers, flying projectile barriers and radiation barriers, and improved barriers for various of the applications, mentioned in my prior patent, U.S. Pat. No. 3,732,653, to which reference is made. Another object is to provide, in general, an improved joint assembly for preformed panel members.

The invention features a structure comprising a series of preformed panel members, joined together at mating elongated male and female joint portions, the joint portions secured together by a series of discrete spaced apart flexible tension members looped about mating edge portions of the panels of large size.

The invention also features such a structure in which each tension member has two discrete terminations, the tension member passing from an abutment face at a first side of a first panel, through a thickness of the panel, thence about the opposite side of the second panel, back through the thickness of the second panel, about its adjacent side, thence back through a thickness of the first panel to the second termination at an abutment face at the second side of the first panel.

In particular embodiments a barrier structure is provided that comprises a series of preformed individual members set edge to edge. Each preformed member has oppositely directed broad surfaces, of considerable height and width and typically has a large width to thickness ratio. The heightwise extending edges are straight and extend the height of the member. The male joint surface is preferably of convex cylindrical shape and has an angular extent greater than 180° while the opposite edge surface is a female joint surface preferably of concave cylindrical shape of the same radius as the convex surface and has an anglar extent of less than 180°. A series of passages are provided along each edge immediately adjacent the cylindrical surface. These passages extend through the preformed member from one broad surface to the other.

In erection, the convex cylindrical surface of one member mates with the concave cylindrical surface of the adjacent member to provide a sight tight joint with contact along both the height and arcuate length of the convex surface over a range of rotated positions of the mated members. A discrete flexible tension member which preferably is of circular cross section extends through each pair of aligned passages on opposite sides of the joint. The tension member forms a loop that encircles the mated convex and concave cylindrical surfaces and is under tension and maintains the cylindrical surfaces in mating engagement while permitting a degree of angular movement of the members relative to one another during assembly, and permanently as desired, but resisting vertical movement of one member relative to the other.

This barrier structure employs modular components of low cost, a preferred material being reinforced concrete although other materials in appropriate instances may be used. The modular components are prefabricated and are capable of easy erection in the desired configuration. A particularly useful arrangement is a zigzag pattern which provides a self-supporting, rugged barrier of considerably greater effective thickness than that of the individual panels that does not require footings or deep excavation and yet is highly stable and durable. The modular components may be twenty feet or more in height and as such are of substantial thickness. In other instances the thickness and resulting weight is reduced, through conformation with a support, for example, a safety barrier that extends along the edge of the highway pavement and is joined to selected modular components of the pattern with other modular components offset at angles to the attached components of the pattern, providing lateral stability. Such a system provides a combined safety barrier and sound barrier in an arrangement that requires a relatively narrow strip of land immediately adjacent to highway pavement. If desired there may be provision for egress from the highway through the barriers—the safety barrier being interrupted and a self-closing door being provided in a sound barrier member that is set back from the safety barrier.

In some sound barrier arrangements selected modular units may be transparent in a pattern. By selecting a series of units facing in the general direction of oncoming traffic, a substantial effective area of visibility through the sound barrier can be provided to front facing occupants of vehicles while substantially shielding the vehicular right of way from view from the opposite side of the barrier.

Barrier constructions in accordance with the invention are useful in numerous other applications, for example, as a series of flat lying panels for the sides of an earthen dam or lining an irrigation canal, as a barrier for erosion control, or as a dismantleable radiation barrier in an atomic power plant. In the latter case a radiation barrier frequently must be erected for safety reasons while components of the power plant, such as the turbines are in operation. In a preferred embodiment the modular units of such a barrier are of reinforced concrete of substantial thickness (of the order of two feet or more) and of substantial height. The units are freestanding on the reinforced floor of the power plant, and are tightly coupled in an offset or zigzag arrangement which provides a highly stable radiation barrier. The positions of individual components can be changed as desired and the wall is easily dismantled and stored during servicing of the power plant unit.

These and numerous other features and advantages will be further understood as the following description of particular embodiments progresses in conjunction with the drawings in which:

FIG. 1 is a perspective view of a sound barrier according to the invention erected along a highway:

FIG. 2 is a perspective view of a modular unit of the barrier of FIG. 1;

FIG. 3 is a sectional view along the line 3—3 of FIG. 2;

FIG. 4 is a perspective view of a tension member employed in the barrier of FIG. 1;

FIG. 4A is a view of a washer plate.

FIG. 5 is a sectional view of a joint structure according to the invention;

FIG. 6 is a perspective view showing erection of panels to form the barrier of FIG. 1;

FIGS. 7–9 are a series of diagrammatic views showing steps in the assembly of a barrier wall joint;

FIGS. 10 and 11 are top and elevational views respectively of a barrier wall according to the invention;

FIGS. 20 and 21 are plan and elevational views respectively of a nuclear power station turbine room with a nuclear radiation barrier according to the invention;

FIG. 22 is a side elevational view of a modular member of the barrier shown in FIGS. 20 and 21 while

DESCRIPTION OF PARTICULAR EMBODIMENTS

Figure 12:
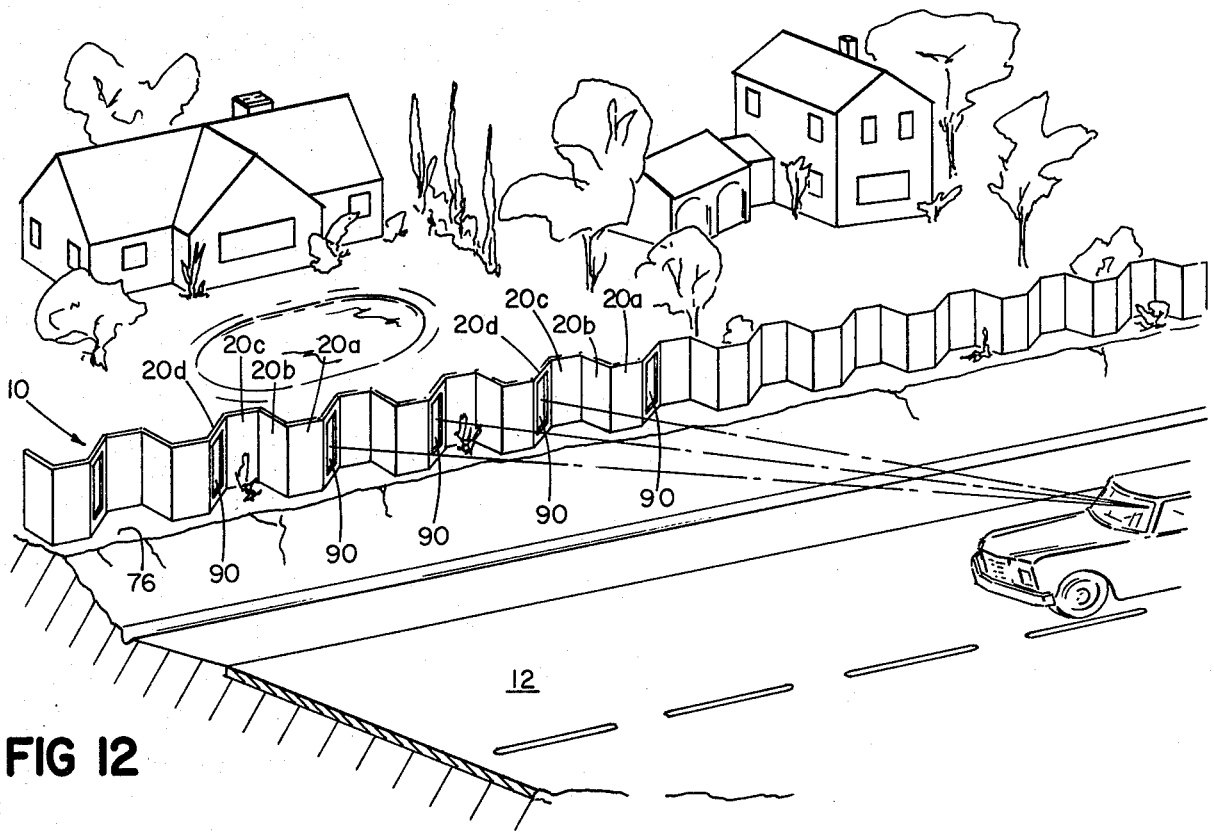
FIG. 12 is a perspective view showing a sound barrier similar to FIG. 1 with transparent inserts in panels that face the oncoming traffic.

Referring to FIG. 1, a barrier 10 extends along the side of highway 12 at the edge of the right of way. The primary function of this barrier is to block traffic noise from vehicles on the highway from the residences 14. Barrier 10 is of sufficient height to extend above the line of sight 15 between the region to be protected and the sound source, here engine exhaust 16, the effective height of the barrier for acoustic design purposes being the perpendicular distance from the line of sight to the top of the barrier.

The barrier 10 is made up of pre-cast reinforced concrete panels 20 set in zigzag or undulating formation. With reference to FIGS. 2 and 3, a typical panel 20 has a height of sixteen feet, a width of eight feet, and is eight inches thick. Each panel has parallel faces 22, 24, a bottom horizontal surface 26 designed for direct contact with the ground, an upper horizontal surface 28, and vertically extending edge surfaces 30, 32. Edge surface 30 is a female surface of concave cylindrical configuration and of 90° angular extent, and edge surface 32 is a male surface of convex cylindrical configuration and of 270° angular extent. Each edge surface 30, 32 has a radius of four inches. A chamfer surface 34 provides a transition between the end of each curved edge surface 30, 32 and the adjacent face 22, 24. Embedded in panel 20 is a grid of vertical and horizontal reinforcing bars 36, 38.

A series of three vertically separated transverse passages 40 pierce the panel, extending from one end of convex surface 32 to the other end as is indicated in FIG. 3. Similarly, three pairs of tangent passages 42, 44 located in vertical positions corresponding to and opposite passages 40, extend from points tangent to concave surface 30 through the panel to recesses 46 in the opposite planar surfaces. Passage 42 extends from an opening chamfer surface 34 adjacent face 24 diagonally through the panel to a recess 46 in face 22. Similarly, passage 44 extends from an opening in chamfer surface 34 adjacent face 22 along a line tangent to surface 30 to recess 46 in face 24, and the two passages are slightly vertically off set from one another. In the top surface of the panel are two threaded sockets 48 designed to receive eye bolts for assistance in supporting the panel when assembling or dismantling the barrier wall (and for bolting on additional heights). A supplemental layer 50, for example, of sound absorbing material, may be provided on one or both surfaces 22, 24 either during the casting process or afterward. If desired, a groove 52 may be provided in concave surface 30 along its entire length and a gasket member disposed in that groove for wiping engagement with the mating convex surface 32. Such a gasket may be used to provide a watertight seal or a fire block, for example, depending on the particular use of the panel.

It will be noted that a vertical reinforcing bar 36*a* is disposed near concave surface 30 and each tangent passage 42, 44, in load receiving relation to the abutment surface 46*a* of recess 46. Similarly, a vertical reinforcing bar 36*b* is disposed between convex surface 32 and each transverse passage 40.

A tension member 60 employed with this joint construction is shown in FIG. 4. That tension member includes a length of flexible stranded stainless steel aircraft-type cable 62 and a ferrule 64 and a threaded cylindrical terminal fitting 66 swaged to the ends of the cable. Fitting 66 is sized in relation to the load it is to carry (e.g., 1 inch diameter fitting for ½ inch diameter cable) and the passages 40, 42 and 44 are sized to pass the fitting 66. Square washer plate 68 seats against abutment surface 46*a* in recess 46 and is held against rotation. The noncircular hole 69 in the washer mates with flats 67 of fitting 66 to prevent rotation of the fitting. Tabs 69, struck from plate 68, are depressed by points of the nut 70 as the nut is tightened and act as a one-way ratchet. Tension member 60 has a simple ferrule 64 at the other end of cable 62. The tension member should have a tensile strength to support the weight of the panel by itself. While a variety of elements such as straps and bands may be employed as flexible tension members, it is preferred that the tension member surface in contact with the cylindrical surface 32 be of circular cross section so that should vertical displacement of one panel 20 occur there will still be no decrease in support circumference between cable and passageways during offset to ensure proper stress transfer.

A joint between two panels 20 is shown in FIG. 5. Concave surface 30 of one panel mates with the convex surface 32 of the adjacent panel. A nut 70 on fitting 66 of tension member 60 is seated on aligning plate 68 in a recess 46, and cable 62 extends from that recess through passage 42 along convex surface 32 to the adjacent panel, through transverse passage 40 and from that passage along convex surface 32 and through passage 44 to ferrule 64 disposed in recess 46 and seated on abutment surface 46*a*. Nut 72 is torqued on threaded fitting 66, applying a predetermined tension to the tension member 60 to bring the convex and concave surfaces 30, 32 into mating engagement and provide a firm interlock between the two panels, which provides a selected resistance to rotation as may be desired, dependent upon the level of torque selected for the nuts.

To assemble the barrier 10, pre-cast panel units 20 are transported to the site—a graded strip 76 at the edge of the right of way of highway 12, upon which the panel units 20 are set along the desired general line of extent of the barrier. In the erection system shown in FIG. 6, the tension members 60 are disposed in passages 40 of an erected panel. The next panel 20a to be erected is moved into position with a crane 82 and lifting bridle 84 attached to eye bolts 86 threadedly received in sockets 48. The concave surface 30 of panel 20a is moved into abutting position with the convex surface 32 of the previously erected panel as indicated by dashed lines in FIG. 7. Each threaded fitting 66 is fed through respective passages 40 and 44 and secured with nut and washer to complete the tensioning loops as indicated in FIG. 8. Vertical panel position is thus established. The panel with three-tensioning loops 60 in position but not under tension is then moved as indicated by dashed lines in FIG. 8 into the angular support position. After that angular position is achieved, tension is applied to each tension loop to bring the concave convex surfaces into firm mating engagement as indicated in FIG. 9. Where greater freedom of angular movement is desired, a lubricating layer may be provided between or on one or both of surfaces 30, 32. As indicated above, a gasket or seal member may be interposed between the mating surfaces 30, 32 which seal is compressed by the tension loops 60.

It will be noted that the curved mating surfaces 30, 32 permit a certain amount of change in the horizontal angle of one panel to the next, e.g., to accommodate rotationally, thermal expansion and contraction. The tension loops 60, however, act to resist edgewise displacement of one panel relative to the other as the tension of loops 60, in response to a vertical shift of one panel relative to the other, increases and urges the mating surfaces 30, 32 into firmer engagement with one another. For antivandalism purposes, the cable 60 may be recessed into a groove on convex surface 32.

From this description it will be noted that the tension members enable accommodation of casting tolerances, i.e., variation in the positions of the passages and surfaces, while permitting the desired amount of tightness and stress transfer to be achieved. Also, the ease and speed of assembly permitted will be readily appreciated, as well as avoiding the need for employment of highly skilled workers.

Noise reducing barrier walls may be provided in a variety of configurations following the above principles. Thus in the particular embodiment shown in FIGS. 12–14 the barrier wall 10 is composed of a repeating series of four panels—three opaque panels 20a, 20b, 20c, and a panel 20d with a transparent insert 90. Panels 20a are set parallel to the edge of the highway right of way; panels 20c are set parallel to panels 20a but offset away from the highway; and panels 20b are set at an angle of 45° and connect panels 20a and 20c to form a free-standing, self-supporting unit; each fourth panel 20d is also set at an angle 45° to panels 20a and 20c but with opposite orientation to panels 20b so that it is generally facing oncoming traffic and connects panel 20c of one set to panel 20a in the next set. Each panel 20d has a transparent insert 90 secured in frame 92. In a system using panels 20 that are five feet in width, insert 90 may have a width of 3½ feet. In this configuration, the line of sight from vehicles at an angle of 15° to the highway provides transparent areas of three-foot projected width spaced at intervals of about two-foot projected width, thus providing an effective transmission area of greater than 50% to frontwards-looking occupants of vehicles traveling along the highway. The projected width of the transparent panels from the opposite (e.g., residential) side from the highway is only about 2½ feet in every 17-foot length of a series of four panels, an optical transmission factor of about 15% and thus the highway is substantially shielded from view on the opposite side of barrier 10. This optical transmission differential thus essentially maintains both the audible and the visual effectiveness of the barrier 10 from the non-highway side while providing a substantial, related view of objects beyond the barrier from the highway side. The high degree of effective transparency presented to the vehicles decreases the perceived visually distracting, mass and height of the barrier, without decreasing its acoustical height and effectiveness.

Figure 15:
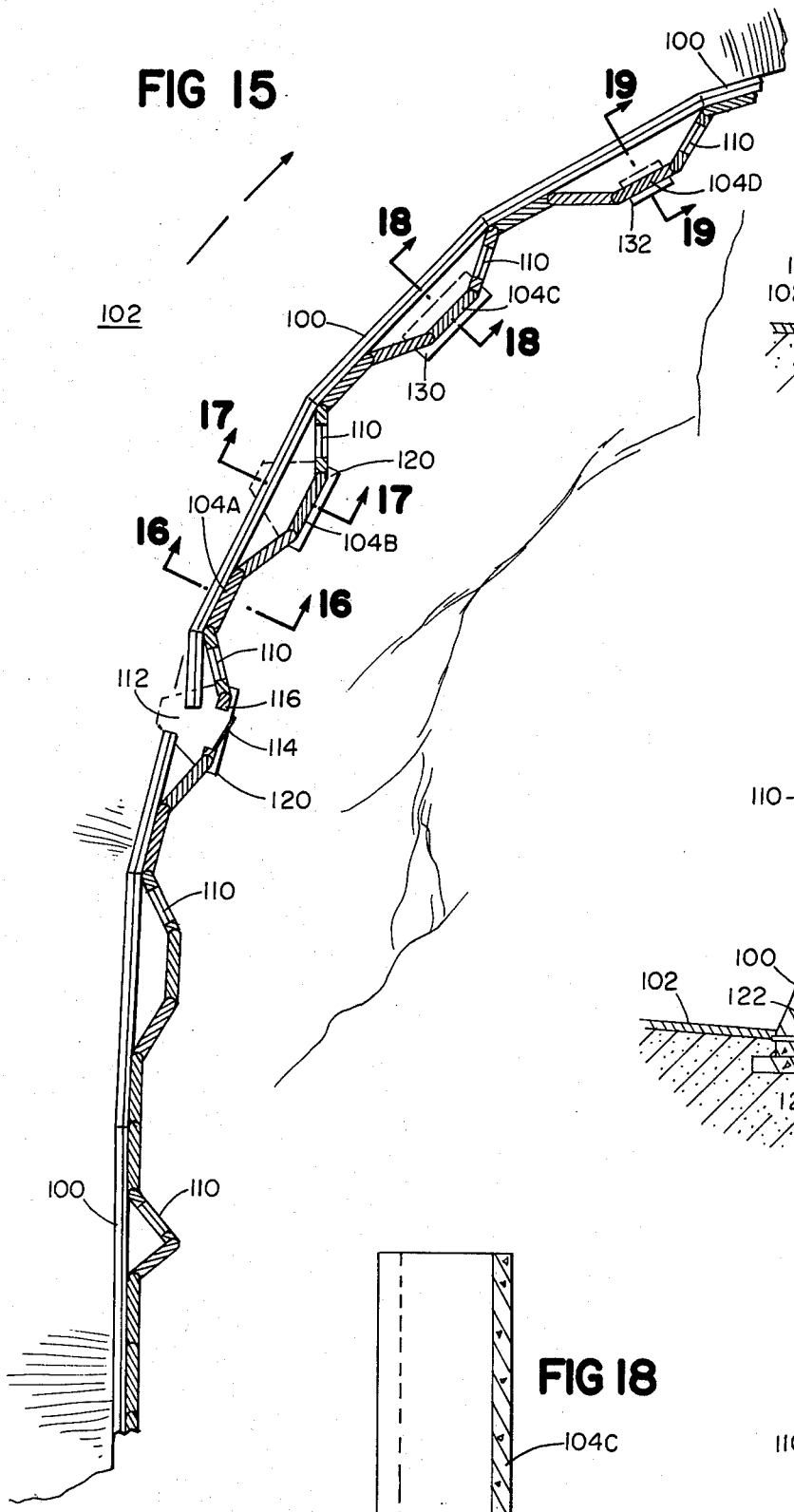
FIG. 15 is a plan view of still another wall construction in which an auxiliary support and barrier system is combined with the wall modules.
Figure 16:
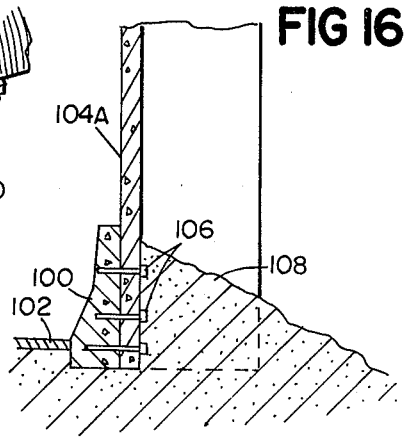
FIGS. 16–19 are sectional views along the lines 16—16, 17—17, 18—18, and 19—19 respectively of FIG. 15.
Figure 17:
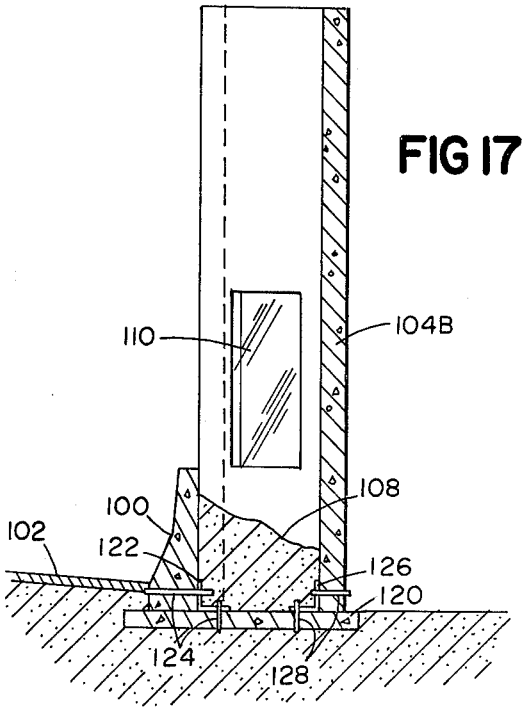

This noise reducing barrier construction may also be used in conjunction with important additional structures for advantageous effect, for example, a slope faced safety barrier of the "Jersey" barrier type as shown in FIGS. 15–19. The "Jersey" type barrier 100 is positioned at and extends along the edge of the pavement 102. In an illustrative configuration, the barrier structure extends about thirty inches above the pavement surface and its base is set fifteen inches below that surface. Utilizing the mass of the safety barrier 100 and its footing as a supplementary support enables the thickness of the vertical sound barrier panels 104 to be reduced, and adds to the stability of both the sound barrier and the Jersey barrier. With reference to FIGS. 15 and 16 the sound barrier is composed of panels 104 set in zigzag self-bracing relation in repeating series of four or five panels with, as shown, one (though permissibly more in other patterns) panel 104 of each series flush against and secured to barrier 100 by bolts 106. The safety barrier and sound barrier assembly is backfilled in conventional manner as indicated at 108. Thus an effective and sturdy sound barrier is provided in conjunction with a safety barrier, in compact arrangement that is located immediately at the pavement edge, which is particularly useful in congested urban areas where it is both difficult and expensive to obtain additional rights of way along the high-way.

Figure 13:
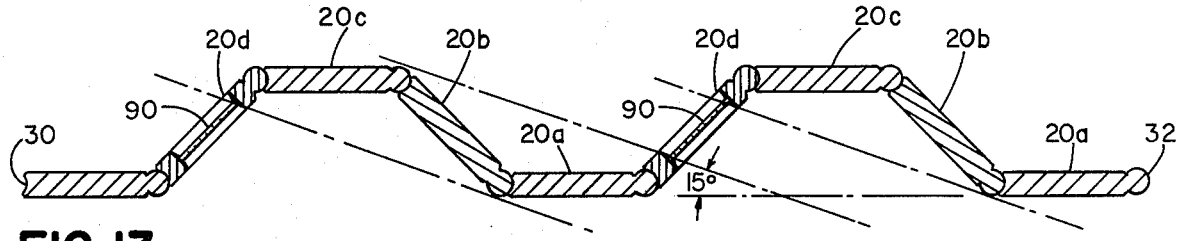
FIG. 13 is a top view and FIG. 14 is a perspective view of panel assemblies of the barrier of FIG. 12.
Figure 14:
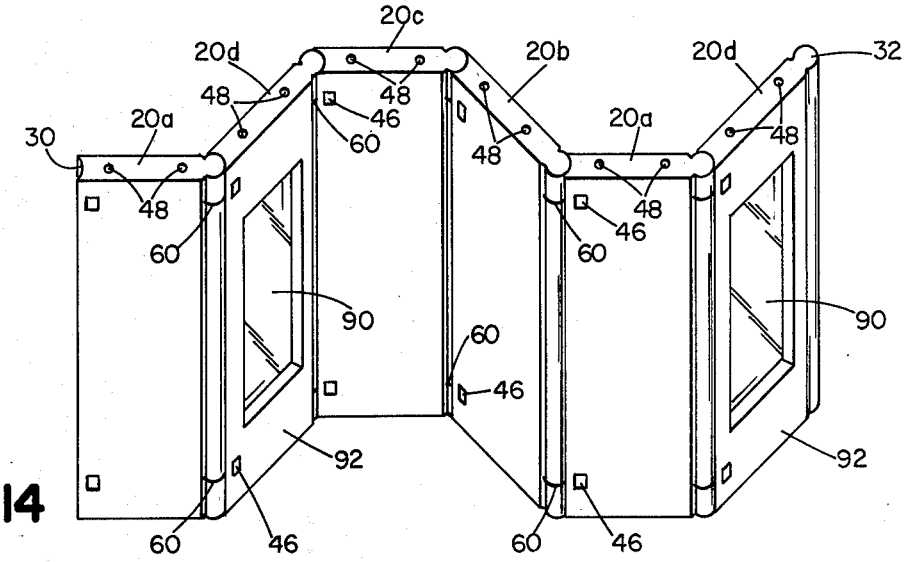

Transparent inserts 110 may be provided in panels 104 that face oncoming traffic in a manner similar to the barrier shown in FIGS. 12–14. Also where pedestrian egress from the highway (for passenger safety in the event of vehicle breakdown for example) is desired, the safety barrier 100 may be interrupted as at 112 to provide a passage and a self-closing door 114 may be provided in the sound barrier panel 116. Thus, the safety and sound barriers are located in these optimum positions close to the traffic with pedestrian egress provided through both barriers, obviating the need for a wide (for safety purposes) pedestrian walkway between the pavement and the safety and sound barriers. It will be noted that, as in the other barrier constructions described herein, panel 116 may be removed simply by releasing the tension loops 60 between it and the two immediately adjacent panels and then lifting the panel 116 vertically, sliding along the mating male and female adge surfaces. The adjacent panels and tension loops are not disturbed and a replacement panel may be lowered into place and secured by refastening the tension loops 60 to recomplete the barrier wall. Similarly additional noise barrier height may be added by bolting to the provided fasteners at the top surface of the panels, as noted previously.

Figure 18:
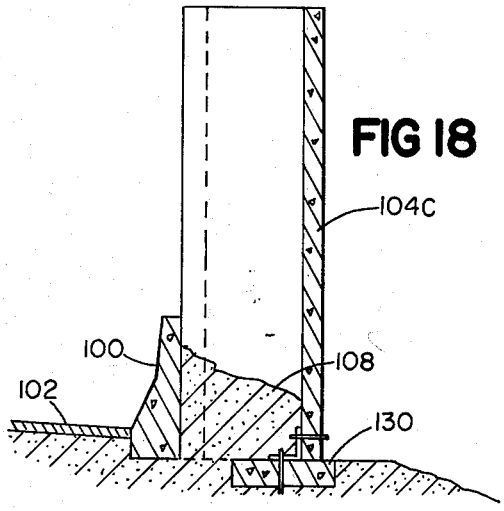
Figure 19:
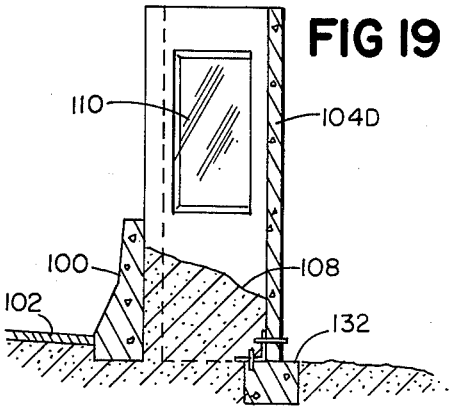

Depending upon site wind and soil conditions, it may be desirable to provide pads under those panels spaced from the "Jersey" barrier 100 to avoid differential settling of portions of the wall. Three different pad configurations are shown in FIGS. 15 and 17–19, a pad 120 of trapezoidal configuration may be utilized. Pad 120 extends beneath and is secured to safety barrier 100 by angle iron 122 and bolts 124. Panel **104*b* is seated on the rear portion of pad 120 and is similarly secured thereto as by angle iron 126 and bolts 128. The rear margins of pad 120 extend beneath the wing joints and thus also provides support for the barrier panels on both sides of panel 104*b*. A second type of pad is shown in FIGS. 15 and 18. That pad 130 is of rectangular configuration and extends the length of panel 104*c* so that it supports both that panel and the edges of one of the immediate adjacent panels but it does not extend forward beneath the "Jersey" barrier 100. A third type of pad is shown in FIGS. 15 and 19, that pad 132 being a rectangular member that supports only panel 104*d*. Each such pad is secured to the panel it supports by suitable means as an angle iron 138 and bolts 136**.

Another feature of the invention is a dismantleable nuclear radiation barrier for use in a nuclear installation. With reference to FIGS. 20 and 21, there is shown a portion of the turbine building of a nuclear power station. Turbines 140 are connected to drive electrical power generator 142.

Figure 22:
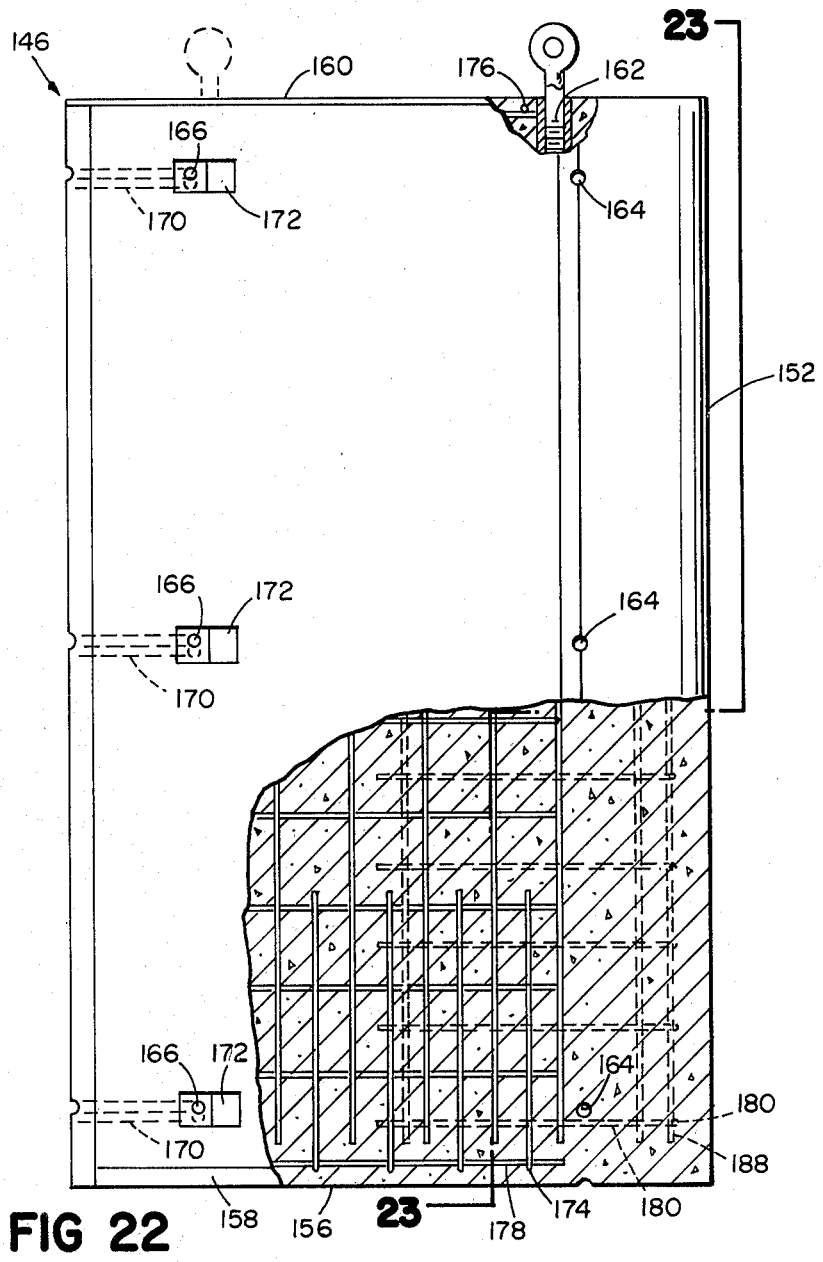
Figure 23:
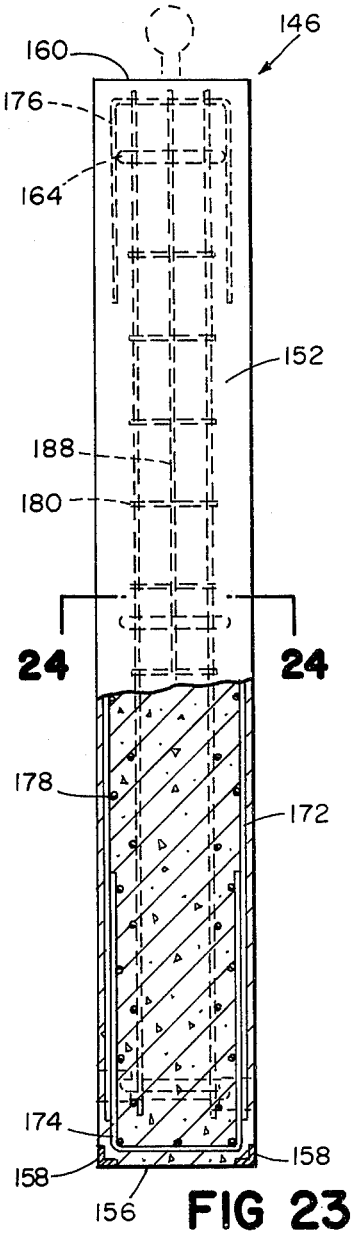
FIG. 23 is an edge view in partial section of the member shown in FIG. 22
Figure 24:
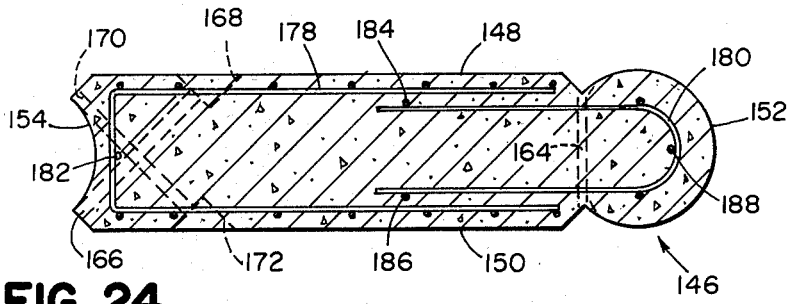
FIG. 24 is a sectional view along the line 24—24 of FIG. 23.

The possibility of release of trace radiation exists and accordingly a radiation barrier must be provided. The barrier 144 shown in FIGS. 20 and 21 may be easily dismantled and stored without harm in preparation for turbine servicing and then reassembled after the turbines have been reassembled. The barrier is a free-standing wall, merely resting at a selected location on the flat floor of the power station in position convenient to permit normal operation or minor servicing, this construction being permitted by the modular, interchangeable, pre-cast reinforced concrete units 146. Each unit 146 is two feet in thickness, fourteen feet high and eight feet in width. Additional details may be seen with reference to FIGS. 22–24. Each unit has parallel flat faces 148, 150, a convex edge surface 152, an opposite concave edge surface 154, a flat bottom horizontal surface 156 (with embedded angles 158) and an upper horizontal surface 160 in which threaded sockets 162 are embedded. Three transverse passages 164 extend through the unit between the margins of convex surface 152; three diagonal passages 166 extend from one margin of concave surface 154 to recesses 168 in face 148; and three further diagonal passages 170 extend from the other margin of concave 154 to recesses 172 in face 150. Reinforcing includes U-members 174, 176 (FIG. 23) vertically disposed at one-foot intervals, horizontally disposed reinforcing U-members 176 and 178 (FIG. 24) also disposed at one-foot intervals, and four vertically disposed rods 182, 184, 186 and 188.

Figure 25:
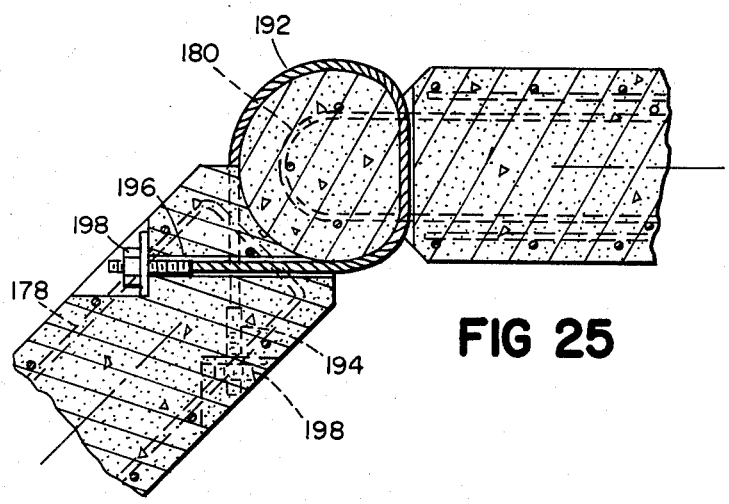
FIG. 25 is a sectional view showing details of a joint employed in the barrier of FIGS. 20 and 21.

Again with reference to FIGS. 20 and 21, the precase units 146 are erected and assembled into the radiation barrier wall form with the use of the bridge crane 190 which is typically avilable for erection and service functions in conjunction with turbine-generator installations of this type. A panel unit 146 is raised to vertical position by the crane and moved into the desired location, without regard to precise position. A second panel is then similarly raised and placed next to the erected panel with its concave joint surface 154 in proximity to the convex surface 152 of the first panel, but not accurately aligned. With reference to FIG. 25, a tensioning cable unit 192 is disposed in each passage 166 with threaded fitting 194 in recess 168. The threaded fitting 196 secured to the other end of the cable is passed through the corresponding transverse passage 164 of the first panel and then through passage 170 of the second panel so that it protrudes from recess 172 in panel face 150. The cable is then tensioned with nuts 198 (with appropriate arrangement to prevent rotation of the threaded fitting 196 for example either by engagement with a keyed member in recess 172 or by an external implement used in conjunction with the wrench to tighten the unit 198 on the threaded fitting 196). As the three cable assemblies 192 are tensioned, the surfaces 152 and 154 are drawn into engagement to form a sturdy stable radiation obstructing joint. It will be noted that the looped tension member extends around reinforcing rods 182 and 188, which rods are inside the U-members 178 and 180 respectively. Thus the tension loop encircles vertically extending reinforcing members which transmit tension forces to the reinforcing grid.

Figure 26:
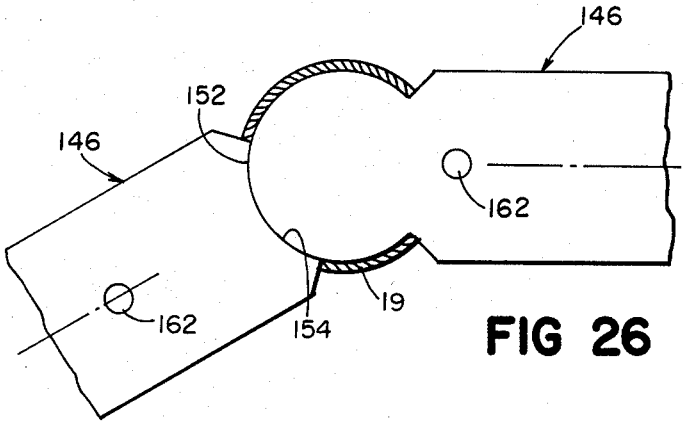
FIGS. 26–28 show different configurations of joints according to the invention.
Figure 27:
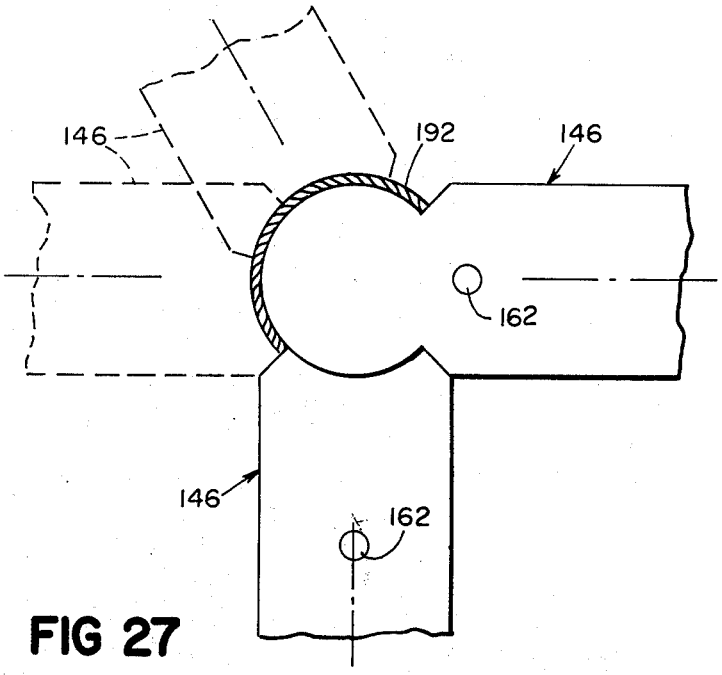
Figure 28:
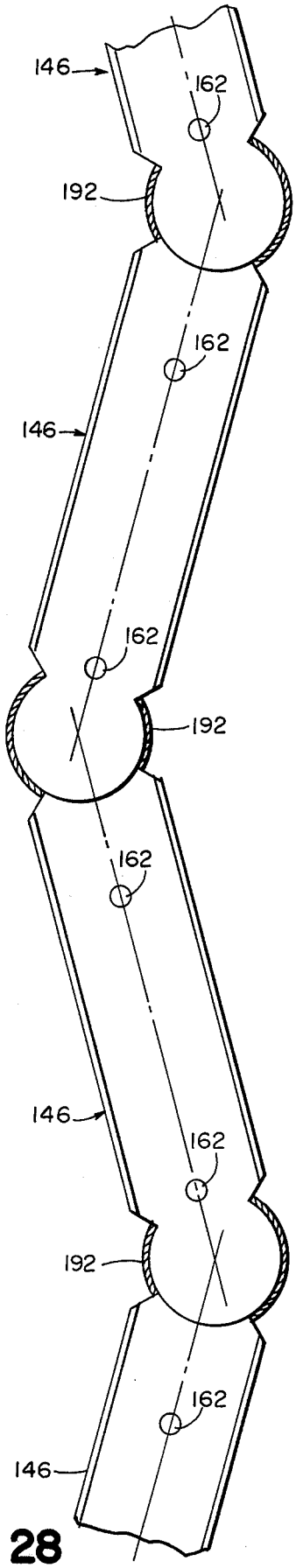

Two adjacent panels may be set at a range of angles relative to one another as indicated in FIGS. 26 and 27, without regard to precision. An installed, adjacent panels support each other, along the mating cylindrical edge surfaces (with effective broad width of the barrier greater than panel thickness) and provide a radiation blocking assembly. The members of the barrier wall may be offset from one another alternately for example at angles of about 10° as indicated in FIG. 28 on an arrangement that provides vertical stability. A barrier panel 146 may be removed from the wall to provide increased access to the turbine (or its position changed for new site conditions) merely by releasing the six tension loop members, and moving the unit with the assistance of crane 190.

It will be understood that numerous variations in the specific details will occur and are within the spirit and the scope of the invention.

I claim:

1. A structure comprising a series of preformed panels joined together at mating elongated male and female joint portions, the joint portions secured together by a series of discrete spaced apart flexible tension members looped about portions of each panel, wherein each tension member has two discrete terminations, the tension member passing from one of said terminations at a cooperating abutment face at a first side of a first panel, through a thickness of the panel, thence about the opposite side of the second panel, back through the thickness of the second panel, about its adjacent side, thence back through a thickness of the first panel to the second termination at a second abutment face at the first panel.

2. The structure of claim 1 for use as a free-standing zigzag wall useful as a sound barrier, as for a highway or railroad, a radiation barrier as for an atomic power plant, or an earth retaining wall, said flexible tension members looped about mating edge margin portions of respective panels.

3. The structure of claim 1 comprising a flat-lying series of panels for the sides of an earthen dam or lining an irrigation canal.

4. The structure of claim 1 wherein said joint portions are shaped to rotate relative to one another about the axis of elongation of said joint portions when said flexible tension members are in place, e.g., during erection, for enabling angular adjustment of said panels relative to one another, prior to final tightening of said tension members, or permanently, to permit relative rotation of said panel members, e.g., to accommodate heat expansion of said panels.

5. The structure of claim 1 wherein said joint portions are urged together under compressive stress in response to tension applied by said series of flexible tension members.

6. A structure comprising a series of preformed panels joined together at mating elongated male and female joint portions, the joint portions secured together by a series of discrete spaced apart flexible tension members looped about portions of each panel wherein said female joint portion comprises an elongated edge of generally concave form of a first said panel and said male joint portion comprises an elongated edge of generally convex form of a second said panel, interfitted with said concave form, said flexible tension member extending from a first face of said first panel, through a thickness of said panel, thence through the thickness of said second panel, thence through a thickness of said first panel to the second face thereof.

7. The structure of claim 6 wherein said tension member terminates at each end in a head portion, the panel at each end shaped to define an abutment surface generally perpendicular to said tension member against which the respective head portion bears, transmitting the tension load of said tension member to the substance of said panel via said abutment surface.

8. The structure of claim 7 wherein at least one of said head portions comprises a threaded nut for tightening said flexible tension member, and means associated with said tension member preventing its rotation during rotation of said threaded nut.

9. A generally horizontally extending barrier wall structure suitable for resting directly upon the earth or other surface comprising a series of preformed, upright, individual wall members set edge to edge in mating engagement, said wall members being offset relative to one another in opposite direction along said series, the angle of offset being 10° or greater to either side, each wall member pair defining one upright edge surface of convex form and the other upright edge surface of concave form, the horizontal extent of said convex surface substantially exceeding the horizontal extent of said concave surface, the convex surface of one member fitting into and engaging the concave surface of the adjacent member, forming therewith a grout-free joint in the manner that the angle of offset between adjacent wall members may be varied while maintaining said engagement, the member pairs constructed to expose to the exterior the portion of said convex surface not engaged by said concave surface regardless of angular relation of the joined wall members, a series of passages extending through the thickness of each wall member of each pair adjacent each said edge, and a plurality of elongated flexible tension members, each disposed in a loop at a joint between the two wall members, each tension member extending through corresponding passages in the adjacent members said against the exposed convex surface of the respective wall member, each said passage through a wall member adjacent a convex edge of said wall member being shaped and positioned to enable the respective tension member to extend from the mating wall member, along a portion of said convex edge of said first mentioned wall member to said passage, thence through said passage while engaging the substance of said wall member, thence along a further portion of said convex edge back toward said mating wall member, said tension members effective to produce substantially uniform compressive engagement between said engaged pairs of edges independent of the angle of said offset of said members, said tension members, in addition to resisting horizontal displacement of said wall members, also effective to resist any tendency for relative vertical displacement of one wall member relative to the other of said pair.

10. The barrier wall of claim 9 wherein said convex edge is of the form of a cylindrical arc of the order of 270° of a cylinder and the respective passage extends between the ends of said arc.

11. The barrier wall structure of claim 9, each wall member being of greater height than width and having a width to thickness ratio of at least ten, each of said wall members defining oppositely directed broad surfaces and straight edge surfaces that extend the height of the member, member pairs defining one edge surface of convex cylindrical shape and having an angular extent greater than 180° and the other edge surface being of concave cylindrical shape of the same radius as said convex surface and having an angular extent of less than 180°, the diameter of said surfaces corresponding substantially to the thickness of said members at said edge surfaces whereby relative rotation can occur over a wide angular range without obstruction, the convex cylindrical surface mating with the concave cylindrical surface of the adjacent member to provide a sight-tight rotatable, grout-free joint with contact along the arcuate length of said convex surface over a range of rotated positions of the mated members.

12. The barrier wall structure of claim 9 in the form of a barrier for shielding portions of a power plant comprising a free-standing series of said wall members, said wall members comprising preformed, reinforced concrete panels.

13. The barrier wall structure of claim 9 in the form of a sound barrier and visual screen structure along a right of way carrying vehicles comprising a safety curb structure extending along said right of way, said series of wall members extending vertically above said safety curb structure and being arranged in groups, at least one panel of each group being disposed parallel with and close to said safety curb structure, and second and third panels of each group being connected at their vertical margins to the vertical margins of adjacent panels and extending away from said safety curb structure providing increased stability for said barrier structure and providing an open space between said safety curb and said panels, and an exit means in said safety curb providing safe exit of personnel from the roadway to said open space.

14. The barrier structure of claim 13 wherein provision is made for safe exit of personnel from the roadway through said sound barrier while maintaining curb restraint for vehicles, and sound sight trespass features of the barrier.

15. A generally horizontally extending barrier wall structure suitable for resting directly upon the earth or other surface in the form of a sound barrier comprising a series of panels extending along a right of way carrying vehicles, the barrier being of zigzag form providing a periodic series of panels facing on-coming vehicles which panels are separated from each other by opaque panels, said series of panels being transparent and providing to an occupant of the vehicle looking ahead a substantially related view of objects beyond the barrier whilst substantially shielding the right of way from viewers on the opposite side of the barrier, said panels comprising a series of preformed, upright, individual wall members set edge to edge in mating engagement, said wall members being offset relative to one another in opposite directions along said series, the angle of offset being 10° or greater to either side, each wall member pair defining one upright edge surface of convex form and the other upright edge surface of concave form, the horizontal extent of said convex surface substantially exceeding the horizontal extent of said concave surface, the convex surface of one member fitting into and engaging the concave surface of the adjacent member, forming therewith a grout-free joint in the manner that the angle of offset between adjacent wall members may be varied while maintaining said engagement, the member pairs constructed to expose to the exterior the portion of said convex surface not engaged by said concave surface regardless of angular relation of the joined wall members, a series of passage extending through the thickness of each wall member of each pair adjacent each said edge, and a plurality of elongated flexible tension members, each disposed in a loop at a joint between the two wall members, each tension member extending through corresponding passages in the adjacent members and against the exposed convex surface of the respective wall member, said tension members effective to produce substantially uniform compressive engagement between said engaged pairs of edges independent of the angle of said offset of said members, said tension members, in addition to resisting horizontal displacement of said wall members, also effective to resist any tendency for relative vertical displacement of one wall member relative to the other of said pair.

16. A sound barrier and visual screen structure along a right of way carrying vehicles comprising a horizontally extending series of preformed broad-faced panels, said panels extending vertically and set at angles to one another in a pattern, certain periodic panels of the series facing oncoming vehicles, a major portion of each of said periodic panels being transparent, and other panels adjacent to said periodic transparent panels in said series being opaque, whereby an occupant of a said vehicle while maintaining forward vision is enabled to have view of objects beyond the barrier while the right of way is substantially shielded from viewers on the opposite side of the barrier.

* * * * *

UNITED STATES PATENT AND TRADEMARK OFFICE

CERTIFICATE OF CORRECTION

PATENT NO. : 4,111,401

DATED : September 5, 1978

INVENTOR(S) : William Hayden Pickett

It is certified that error appears in the above-identified patent and that said Letters Patent are hereby corrected as shown below:

Col. 6, line 57, "adge" should be --edge--;

Col. 7, line 47, after "concave" insert --surface--;

Col. 7, line 54, "pre-case" should be --pre-cast--;

Col. 7, line 56, "avilable" should be --available--;

Col. 8, line 19, "An" should be --As--;

Col. 9, line 54, "said" should be --and--;

Col. 11, line 17, "passage" should be --passages--

Signed and Sealed this

*Twenty-fourth* Day of *April 1979*

[SEAL]

*Attest:*

RUTH C. MASON
*Attesting Officer*

DONALD W. BANNER
*Commissioner of Patents and Trademarks*